US011837161B2

(12) United States Patent
Hyeon et al.

(10) Patent No.: US 11,837,161 B2
(45) Date of Patent: Dec. 5, 2023

(54) DISPLAY DEVICE AND CONTROL METHOD THEREFOR

(71) Applicant: SAMSUNG ELECTRONICS CO., LTD., Suwon-si (KR)

(72) Inventors: Byeongcheol Hyeon, Suwon-si (KR); Jaehyang Lee, Suwon-si (KR); Jiyong Park, Suwon-si (KR); Taeje Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 18/103,691

(22) Filed: Jan. 31, 2023

(65) Prior Publication Data

US 2023/0186837 A1 Jun. 15, 2023

Related U.S. Application Data

(63) Continuation of application No. PCT/KR2021/007697, filed on Jun. 18, 2021.

(30) Foreign Application Priority Data

Jul. 31, 2020 (KR) ..... 10-2020-0096072

(51) Int. Cl.
*G09G 3/32* (2016.01)

(52) U.S. Cl.
CPC ..... *G09G 3/32* (2013.01); *G09G 2300/0408* (2013.01); *G09G 2300/0452* (2013.01);
(Continued)

(58) Field of Classification Search
CPC ..... G09G 3/32; G09G 2310/0264; G09G 2300/0452; G09G 2300/0408;
(Continued)

(56) References Cited

U.S. PATENT DOCUMENTS

| | | | |
|---|---|---|---|
| 9,159,272 | B2 | 10/2015 | Murai et al. |
| 9,491,449 | B2 | 11/2016 | Kim et al. |
| 9,805,676 | B2 | 10/2017 | Koyama et al. |
| 10,431,148 | B2 | 10/2019 | Kim et al. |

(Continued)

FOREIGN PATENT DOCUMENTS

| | | | |
|---|---|---|---|
| JP | 5400949 | B2 | 1/2014 |
| JP | 2014-130340 | A | 7/2014 |

(Continued)

OTHER PUBLICATIONS

Search Report (PCT/ISA/210) dated Sep. 16, 2021 by the International Searching Authority for International Patent Application No. PCT/KR2021/007697.

Written Opinion (PCT/ISA/237) dated Sep. 16, 2021 by the International Searching Authority for International Patent Application No. PCT/KR2021/007697.

*Primary Examiner* — Muhammad N Edun

(74) *Attorney, Agent, or Firm* — Sughrue Mion, PLLC

(57) ABSTRACT

A display device and a control method therefor are provided. The display device includes: a display panel including a plurality of pixels consisting of a plurality of light emitting devices of different colors; a sensor for sensing a temperature of the display panel; a driver IC for driving the plurality of pixels; a memory storing a plurality of pieces of correction data; and a processor configured to execute the at least one instruction to identify, on the basis of the temperature sensed by the sensor, correction data corresponding to the sensed temperature from among the plurality of pieces of stored correction data, correct image data on the basis of the correction data, and control the driver IC on the basis of the corrected image data.

20 Claims, 15 Drawing Sheets

(52) U.S. Cl.
CPC ..... *G09G 2310/0264* (2013.01); *G09G 2320/0233* (2013.01); *G09G 2320/041* (2013.01); *G09G 2320/06* (2013.01)

(58) Field of Classification Search
CPC ..... G09G 2320/0233; G09G 2320/041; G09G 2320/06
See application file for complete search history.

(56) References Cited

U.S. PATENT DOCUMENTS

| | | | | |
|---|---|---|---|---|
| 10,885,841 | B2 | 1/2021 | Kho | |
| 2017/0352310 | A1* | 12/2017 | Kim | G09G 3/32 |
| 2018/0075798 | A1* | 3/2018 | Nho | G09G 3/32 |
| 2018/0090062 | A1 | 3/2018 | Nakamura | |
| 2021/0043821 | A1* | 2/2021 | Hussell | H01L 25/167 |

FOREIGN PATENT DOCUMENTS

| | | | |
|---|---|---|---|
| JP | 2018-54915 | A | 4/2018 |
| JP | 2021-135445 | A | 9/2021 |
| KR | 10-2009-0049669 | A | 5/2009 |
| KR | 10-2009-0077184 | A | 7/2009 |
| KR | 10-0943863 | B1 | 2/2010 |
| KR | 10-0984314 | B1 | 9/2010 |
| KR | 10-2015-0060446 | A | 6/2015 |
| KR | 10-1676644 | B1 | 11/2016 |
| KR | 10-2017-0073364 | A | 6/2017 |
| KR | 10-2017-0137456 | A | 12/2017 |
| KR | 10-2019-0027689 | A | 3/2019 |
| KR | 10-2020-0067389 | A | 6/2020 |
| KR | 10-2020-0072738 | A | 6/2020 |
| KR | 10-2387612 | B1 | 4/2022 |

* cited by examiner

FIG. 5A

510

| | | | | | | | | | |
|---|---|---|---|---|---|---|---|---|---|
| 90 | 80 | 90 | 90 | 90 | 90 | 90 | 90 | 80 | 90 |
| 80 | 80 | 90 | 80 | 80 | 80 | 80 | 90 | 80 | 80 |
| 80 | 80 | 90 | 80 | 80 | 80 | 80 | 90 | 80 | 80 |
| 80 | 90 | 100 | 90 | 90 | 90 | 90 | 100 | 90 | 80 |
| 90 | 80 | 90 | 90 | 90 | 90 | 90 | 90 | 80 | 90 |
| 80 | 80 | 90 | 80 | 80 | 80 | 80 | 90 | 80 | 80 |
| 80 | 80 | 90 | 80 | 80 | 80 | 80 | 90 | 80 | 80 |
| 90 | 80 | 90 | 90 | 90 | 90 | 90 | 90 | 80 | 90 |

FIG. 5B

520

| | | | | | | | | | |
|---|---|---|---|---|---|---|---|---|---|
| 0.9 | 0.8 | 0.9 | 0.9 | 0.9 | 0.9 | 0.9 | 0.9 | 0.8 | 0.9 |
| 0.8 | 0.8 | 0.9 | 0.8 | 0.8 | 0.8 | 0.8 | 0.9 | 0.8 | 0.8 |
| 0.8 | 0.8 | 0.9 | 0.8 | 0.8 | 0.8 | 0.8 | 0.9 | 0.8 | 0.8 |
| 0.8 | 0.9 | 1.0 | 0.9 | 0.9 | 0.9 | 0.9 | 1.0 | 0.9 | 0.8 |
| 0.9 | 0.8 | 0.9 | 0.9 | 0.9 | 0.9 | 0.9 | 0.9 | 0.8 | 0.9 |
| 0.8 | 0.8 | 0.9 | 0.8 | 0.8 | 0.8 | 0.8 | 0.9 | 0.8 | 0.8 |
| 0.8 | 0.8 | 0.9 | 0.8 | 0.8 | 0.8 | 0.8 | 0.9 | 0.8 | 0.8 |
| 0.9 | 0.8 | 0.9 | 0.9 | 0.9 | 0.9 | 0.9 | 0.9 | 0.8 | 0.9 |

FIG. 6A

610

| | | | | | | | | | |
|---|---|---|---|---|---|---|---|---|---|
| 80 | 70 | 80 | 80 | 80 | 80 | 80 | 80 | 70 | 80 |
| 70 | 70 | 80 | 70 | 70 | 70 | 70 | 80 | 70 | 70 |
| 70 | 70 | 80 | 70 | 70 | 70 | 70 | 80 | 70 | 70 |
| 70 | 80 | 90 | 80 | 80 | 80 | 80 | 90 | 80 | 70 |
| 80 | 70 | 80 | 80 | 80 | 80 | 80 | 80 | 70 | 80 |
| 70 | 70 | 80 | 70 | 70 | 70 | 70 | 80 | 70 | 70 |
| 70 | 70 | 80 | 70 | 70 | 70 | 70 | 80 | 70 | 70 |
| 80 | 70 | 80 | 80 | 80 | 80 | 80 | 80 | 70 | 80 |

FIG. 6B

620

| | | | | | | | | | |
|---|---|---|---|---|---|---|---|---|---|
| 0.8 | 0.7 | 0.8 | 0.8 | 0.8 | 0.8 | 0.8 | 0.8 | 0.7 | 0.8 |
| 0.7 | 0.7 | 0.8 | 0.7 | 0.7 | 0.7 | 0.7 | 0.8 | 0.7 | 0.7 |
| 0.7 | 0.7 | 0.8 | 0.7 | 0.7 | 0.7 | 0.7 | 0.8 | 0.7 | 0.7 |
| 0.7 | 0.8 | 0.9 | 0.8 | 0.8 | 0.8 | 0.8 | 0.9 | 0.8 | 0.7 |
| 0.8 | 0.7 | 0.8 | 0.8 | 0.8 | 0.8 | 0.8 | 0.8 | 0.7 | 0.8 |
| 0.7 | 0.7 | 0.8 | 0.7 | 0.7 | 0.7 | 0.7 | 0.8 | 0.7 | 0.7 |
| 0.7 | 0.7 | 0.8 | 0.7 | 0.7 | 0.7 | 0.7 | 0.8 | 0.7 | 0.7 |
| 0.8 | 0.7 | 0.8 | 0.8 | 0.8 | 0.8 | 0.8 | 0.8 | 0.7 | 0.8 |

FIG. 7

520

| | | | | | | | | | |
|---|---|---|---|---|---|---|---|---|---|
| 0.9 | 0.8 | 0.9 | 0.9 | 0.9 | 0.9 | 0.9 | 0.9 | 0.8 | 0.9 |
| 0.8 | 0.8 | 0.9 | 0.8 | 0.8 | 0.8 | 0.8 | 0.9 | 0.8 | 0.8 |
| 0.8 | 0.8 | 0.9 | 0.8 | 0.8 | 0.8 | 0.8 | 0.9 | 0.8 | 0.8 |
| 0.8 | 0.9 | 1.0 | 0.9 | 0.9 | 0.9 | 0.9 | 1.0 | 0.9 | 0.8 |
| 0.9 | 0.8 | 0.9 | 0.9 | 0.9 | 0.9 | 0.9 | 0.9 | 0.8 | 0.9 |
| 0.8 | 0.8 | 0.9 | 0.8 | 0.8 | 0.8 | 0.8 | 0.9 | 0.8 | 0.8 |
| 0.8 | 0.8 | 0.9 | 0.8 | 0.8 | 0.8 | 0.8 | 0.9 | 0.8 | 0.8 |
| 0.9 | 0.8 | 0.9 | 0.9 | 0.9 | 0.9 | 0.9 | 0.9 | 0.8 | 0.9 |

620

| | | | | | | | | | |
|---|---|---|---|---|---|---|---|---|---|
| 0.8 | 0.7 | 0.8 | 0.8 | 0.8 | 0.8 | 0.8 | 0.8 | 0.7 | 0.8 |
| 0.7 | 0.7 | 0.8 | 0.7 | 0.7 | 0.7 | 0.7 | 0.8 | 0.7 | 0.7 |
| 0.7 | 0.7 | 0.8 | 0.7 | 0.7 | 0.7 | 0.7 | 0.8 | 0.7 | 0.7 |
| 0.7 | 0.8 | 0.9 | 0.8 | 0.8 | 0.8 | 0.8 | 0.9 | 0.8 | 0.7 |
| 0.8 | 0.7 | 0.8 | 0.8 | 0.8 | 0.8 | 0.8 | 0.8 | 0.7 | 0.8 |
| 0.7 | 0.7 | 0.8 | 0.7 | 0.7 | 0.7 | 0.7 | 0.8 | 0.7 | 0.7 |
| 0.7 | 0.7 | 0.8 | 0.7 | 0.7 | 0.7 | 0.7 | 0.8 | 0.7 | 0.7 |
| 0.8 | 0.7 | 0.8 | 0.8 | 0.8 | 0.8 | 0.8 | 0.8 | 0.7 | 0.8 |

720

| | | | | | | | | | |
|---|---|---|---|---|---|---|---|---|---|
| 0.85 | 0.75 | 0.85 | 0.85 | 0.85 | 0.85 | 0.85 | 0.85 | 0.75 | 0.85 |
| 0.75 | 0.75 | 0.85 | 0.75 | 0.75 | 0.75 | 0.75 | 0.85 | 0.75 | 0.75 |
| 0.75 | 0.75 | 0.85 | 0.75 | 0.75 | 0.75 | 0.75 | 0.85 | 0.75 | 0.75 |
| 0.75 | 0.85 | 0.95 | 0.85 | 0.85 | 0.85 | 0.85 | 0.95 | 0.85 | 0.75 |
| 0.85 | 0.75 | 0.85 | 0.85 | 0.85 | 0.85 | 0.85 | 0.85 | 0.75 | 0.85 |
| 0.75 | 0.75 | 0.85 | 0.75 | 0.75 | 0.75 | 0.75 | 0.85 | 0.75 | 0.75 |
| 0.75 | 0.75 | 0.85 | 0.75 | 0.75 | 0.75 | 0.75 | 0.85 | 0.75 | 0.75 |
| 0.85 | 0.75 | 0.85 | 0.85 | 0.85 | 0.85 | 0.85 | 0.85 | 0.75 | 0.85 |

DISPLAY DEVICE AND CONTROL METHOD THEREFOR

CROSS-REFERENCE TO RELATED APPLICATION(S)

This application is a bypass continuation of PCT International Application No. PCT/KR2021/007697, which was filed on Jun. 18, 2021, and claims priority to Korean Patent Application No. 10-2020-0096072, filed on Jul. 31, 2020, in the Korean Intellectual Property Office, the disclosure of which is incorporated herein by reference in its entirety.

BACKGROUND

1. Field

This disclosure relates to a display device and a control method thereof, and more particularly, to a display device capable of improving luminance uniformity of a screen and a control method thereof.

2. Description of Related Art

With the development of semiconductor technology, various electronic devices have been developed, such as display devices including light emitting diodes (LEDs) with a plurality of light emitting elements (e.g., Red sub-pixels, Green sub-pixels, and Blue sub-pixels).

Each of a plurality of LEDs included in a display device may display various images according to the LED driver integrated circuit (IC).

When the LED driver IC is driven, the LED driver IC may generate heat, and accordingly, a high temperature may be applied to the LED adjacent to the LED driver IC.

Since the intensity of light output by the LED decreases as the temperature increases, there is a problem in that heat generated from the LED driver IC causes the LED to output light of low luminance, and the luminance uniformity of the display is deteriorated.

SUMMARY

Provided are a display device for displaying an image according to image data corrected based on correction data for improving luminance uniformity, and a control method thereof.

According to an aspect of the disclosure a display device includes: a display panel including a plurality of pixels of a plurality of light emitting elements of different colors; a sensor configured to sense a temperature of the display panel; a driver integrated circuit (IC) configured to drive the plurality of pixels; a memory storing a plurality of correction data corresponding to a plurality of temperatures, and at least one instruction; and a processor. The processor is configured to execute the at least one instruction to: identify, based on the temperature of the display panel, correction data corresponding to the temperature of the display panel from among the plurality of correction data, correct image data based on the plurality of correction data, and control the driver IC based on the corrected image data, where at least one of information about positions of pixels to be corrected and information about correction coefficients for each pixel, included in each of the plurality of correction data may be different for each of the plurality of correction data.

The driver IC may be disposed on a rear surface of a substrate inside the display panel, and the positions of pixels to be corrected and the correction coefficients for each pixel, included in each of the plurality of correction data, are determined based on distance from the driver IC.

The correction coefficients for each pixel may be set to be smaller as the distance from the driver IC may be farther.

A luminance value of at least one of the plurality of pixels may be lower than a luminance value based on the image data before the image data may be corrected.

The plurality of correction data may be obtained, in a state where each of the plurality of temperatures may be sensed by the sensor, based on luminance values of the plurality of pixels measured while a test image may be displayed on the display panel.

Each of the plurality of pixels may include a plurality of light emitting elements, and the plurality of light-emitting elements comprise a red (R) sub-pixel, a green (G) sub-pixel, and a blue (B) sub-pixel, and the processor may be further configured to correct, based on the correction data, the image data corresponding to the R sub-pixel among the plurality of light emitting elements included in at least one of the plurality of pixels.

The processor may be further configured to execute the instructions to: generate, based on the temperature sensed by the sensor being a third temperature between a first temperature and a second temperature, first correction data corresponding to the first temperature and third correction data corresponding to the third temperature by applying interpolation to second correction data corresponding to the second temperature, among the plurality of correction data; and correct the image data based on the third correction data.

The plurality of light emitting elements may be a micro light emitting diode (LED).

A plurality of driver ICs may be disposed on the rear surface of the display panel, and the sensor may be disposed at a region adjacent to the plurality of driver ICs.

The sensor may be disposed on a substrate inside the display panel.

According to an aspect of the disclosure, a method of controlling a display device that includes a plurality of pixels of a plurality of light emitting elements of different colors, includes: identifying correction data corresponding to a sensed temperature from among a plurality of correction data; correcting an image data based on the correction data; and controlling a driver integrated circuit (IC) based on the corrected image data, where at least one of information about positions of pixels to be corrected and information about correction coefficients for each pixel, included in each of the plurality of correction data may be different for each of the plurality of correction data.

The driver IC may be disposed on a rear surface of a substrate inside the display device, and the positions of pixels to be corrected and the correction coefficients for each pixel, included in each of the plurality of correction data, may be determined based on distance from the driver IC.

The correction coefficients for each pixel may be set to be smaller as the distance from the driver IC may be farther.

A luminance value of at least one of the plurality of pixels may be lower than a luminance value based on the image data before the image data may be corrected.

The plurality of correction data may be obtained, in a state where each of a plurality of temperatures may be sensed by a sensor, based on luminance values of the plurality of pixels measured while a test image may be displayed on a display panel of the display device.

According to an aspect of the disclosure, a non-transitory computer readable medium for storing computer readable program code or instructions which are executable by one or more processors to perform a method of controlling a display device includes a plurality of pixels of a plurality of light emitting elements of different colors. The method includes: identifying correction data corresponding to a sensed temperature from among a plurality of correction data; correcting an image data based on the correction data; and controlling a driver integrated circuit (IC) based on the corrected image data, where at least one of information about positions of pixels to be corrected and information about correction coefficients for each pixel, included in each of the plurality of correction data may be different for each of the plurality of correction data.

The driver IC may be disposed on a rear surface of a substrate inside the display device, and the positions of pixels to be corrected and the correction coefficients for each pixel, included in each of the plurality of correction data, may be determined based on distance from the driver IC.

The correction coefficients for each pixel may be set to be smaller as the distance from the driver IC may be farther.

A luminance value of at least one of the plurality of pixels may be lower than a luminance value based on the image data before the image data may be corrected. The plurality of correction data may be obtained, in a state where each of a plurality of temperatures may be sensed by a sensor, based on luminance values of the plurality of pixels measured while a test image may be displayed on a display panel of the display device.

According to various embodiments of the disclosure, a display device for correcting image data according to correction data determined based on temperature of a display panel and a method for controlling the same may be provided. In this way, the display device may display an image having high luminance uniformity in various environments.

BRIEF DESCRIPTION OF THE DRAWINGS

The above and other aspects, features, and advantages of certain embodiments of the present disclosure will be more apparent from the following description taken in conjunction with the accompanying drawings, in which:

FIG. 5A is a diagram illustrating a luminance value by pixels measured at first temperature according to an embodiment of the disclosure;

FIG. 5B is a diagram illustrating first correction data according to an embodiment of the disclosure;

FIG. 6A is a diagram illustrating a luminance value for each pixel measured at second temperature according to an embodiment of the disclosure;

FIG. 6B is a diagram illustrating second correction data according to an embodiment of the disclosure;

FIG. 7 is a diagram illustrating an embodiment of generating correction data based on interpolation according to an embodiment of the disclosure;

DETAILED DESCRIPTION

The terms used in the present specification and the claims are general terms identified in consideration of the functions of the various embodiments of the disclosure. However, these terms may vary depending on intention, technical interpretation, emergence of new technologies, and the like of those skilled in the related art. Some terms may be selected by an applicant arbitrarily, and the meaning thereof will be described in the detailed description. Unless there is a specific definition of a term, the term may be construed based on the overall contents and technological understanding of those skilled in the related art.

When it is decided that a detailed description for the known art related to the disclosure may unnecessarily obscure the gist of the disclosure, the detailed description may be shortened or omitted. While each embodiment may be implemented or operated independently, each embodiment may be implemented or operated in combination.

Furthermore, although the embodiments of the disclosure will be described in detail with reference to the accompanying drawings and the contents set forth in the accompanying drawings, the disclosure is not limited to the embodiments.

The disclosure will be further described with reference to the drawings.

Figure 1A:
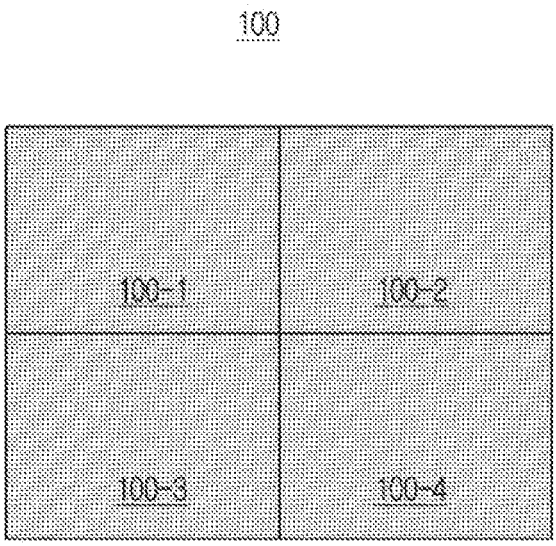
FIG. 1A is a diagram illustrating a display device according to an embodiment of the disclosure.

FIG. 1A is a diagram illustrating a display device according to an embodiment of the disclosure. Referring to FIG. 1A, a display device 100 may be a modular display device including a plurality of display devices 100-1, 100-2, 100-3, and 100-4. Each of the display devices 100-1, 100-2, 100-3, and 100-4 may be referred to as a sub-screen or a cabinet. Hereinafter, for convenience of description, the plurality of display devices 100-1, 100-2, 100-3, and 100-4 are referred to as a plurality of cabinets 100-1, 100-2, 100-3, and 100-4.

Figure 1B:
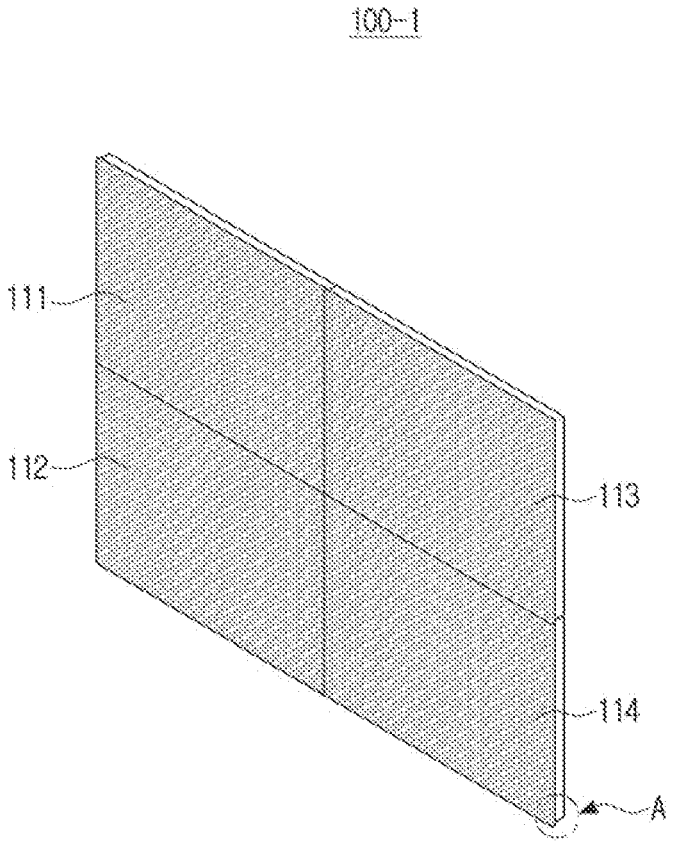
FIG. 1B is a diagram illustrating a cabinet of a display device according to an embodiment of the disclosure.

FIG. 1B is a diagram illustrating a cabinet of a display device according to an embodiment of the disclosure. Referring to FIG. 1B, the cabinet 100-1 of the display device 100 may include one or a plurality of display modules.

For example, the cabinet 100-1 may include display modules 111, 112, 113, and 114. Here, each of the display modules 111, 112, 113, and 114 may be physically connected to form one display.

Each of the display modules 111, 112, 113, and 114 may be implemented as an inorganic light emitting diode (LED) display module including an LED.

Figure 1C:
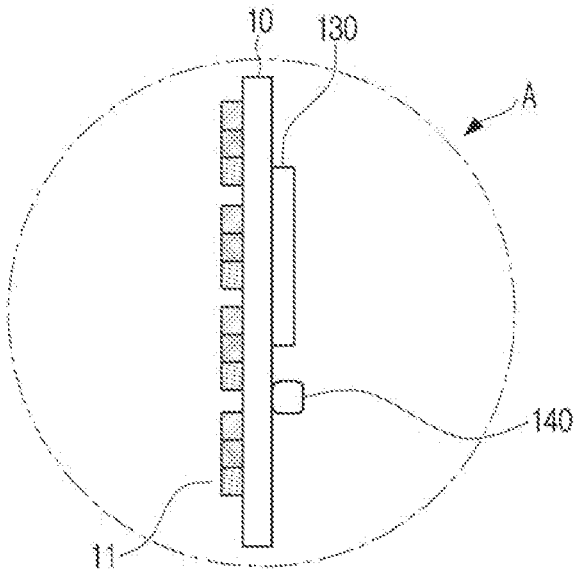
FIG. 1C is a diagram illustrating a side of a display device according to an embodiment of the disclosure.

FIG. 1C is a diagram illustrating a side of a display device according to an embodiment of the disclosure. Referring to FIG. 1C each of the display modules 111, 112, 113, and 114 may be implemented as an LED display module including a plurality of pixels 11 in which sub-pixels of a red LED, a green LED, and a blue LED are implemented in one chip.

According to an embodiment, the above-described LED may be a micro LED. A micro LED is an LED having a size of about 5 to 100 micrometers, and may be a micro light emitting element that emits light by itself without a color filter.

As illustrated in FIG. 1C, the plurality of pixels may be disposed on a first surface of the substrate 10 and may be electrically connected to the driver IC 130 disposed on a second surface of the substrate 10. Each of the plurality of pixels may emit light of various intensities based on the magnitude of the current output by the driver IC 130 or the magnitude of the voltage applied by the driver IC 130. A sensor 140 for sensing a temperature may be further included on the second surface of the substrate 10. This will be described later with reference to FIG. 2.

According to an embodiment, the plurality of pixels may be arranged in a matrix form (e.g., M×N, where M and N are natural numbers). The matrix may be in the form of a rectangular array (e.g., M=N, where M and N are natural numbers, 16×16 array, 24×24 array, etc.), or may be a different array (e.g., M≠N, where M and N are natural numbers).

The above-described LED display module is only an example, and the display module may be implemented as a liquid crystal panel (LCD), an organic LED (OLED), an active-matrix OLED (AMOLED), a plasma display panel (PDP), or the like.

Referring back to FIG. 1B, the cabinet 100-1 may be implemented in a format in which the plurality of display modules 111, 112, 113, and 114 are coupled in a 2×2 array.

However, the LED display module in 2×2 array is merely one embodiment, and the array format and the number of LED display module may be changed according to various embodiments.

The cabinet 100-1 may be connected to other adjacent cabinets to implement the display device 100. For example, each of the plurality of cabinets 100-1, 100-2, 100-3, and 100-4 may be connected to each other in a daisy chain manner, but is not limited thereto.

Here, the display device 100 including a plurality of cabinets may be referred to as a wall display, a video wall, or the like.

Figure 1D:
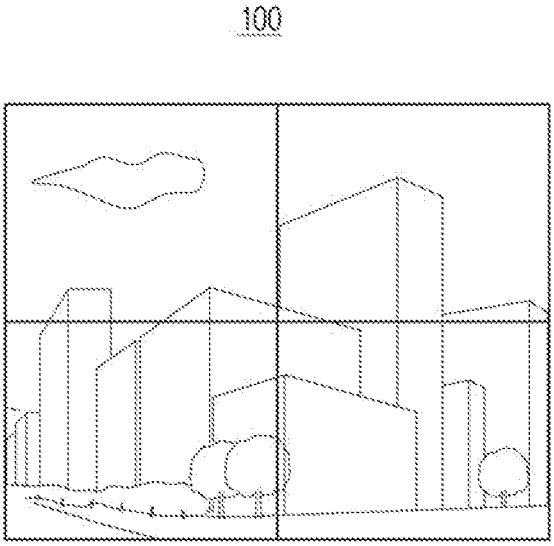
FIG. 1D is a diagram illustrating an image displayed on a display device according to an embodiment of the disclosure.

FIG. 1D is a diagram illustrating an image displayed on a display device according to an embodiment of the disclosure. Referring to FIG. 1D, a plurality of cabinets 100-1, 100-2, 100-3, and 100-4 may be connected in a 2×2 format. The 2×2 array is an example, and the array format and number of cabinets included in the display device 100 may be different depending on the embodiment.

The display device 100 may display an image through a display module included in each of the plurality of cabinets. Here, the image may be an image previously stored in the display device 100 as well as an image received from an external device (e.g., a set-top box, a computer, a server, etc.).

The display device 100 may transmit an image signal to the plurality of cabinets 100-1, 100-2, 100-3, and 100-4 corresponding to each cabinet in the plurality of cabinets 100-1, 100-2, 100-3, and 100-4. The driver IC 130 in each cabinet 100-1, 100-2, 100-3, and 100-4 may display an image based on the received image signal. As shown in FIG. 1D, the display device 100 may display an image through a display module included in each of the plurality of cabinets 100-1, 100-2, 100-3, and 100-4.

Although an embodiment in which the display device 100 of the disclosure is implemented as a modular display device has been described above, this is merely exemplary, and the display device 100 may be implemented as a general display device such as a TV.

Figure 2:
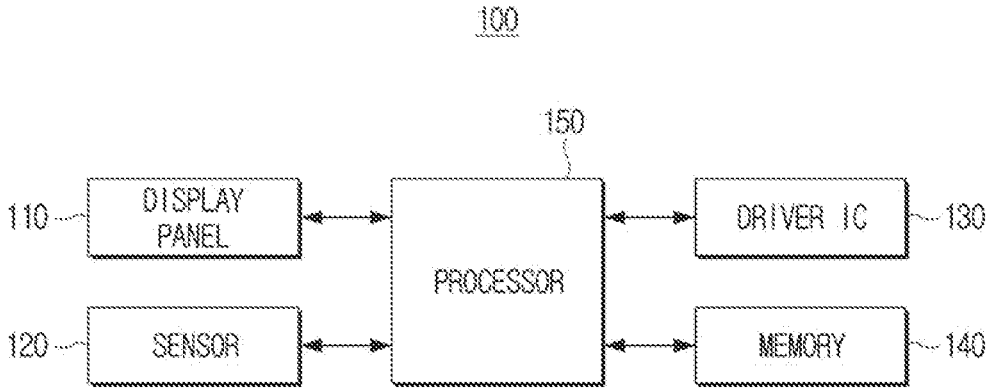
FIG. 2 is a block diagram illustrating a display device according to an embodiment of the disclosure.

FIG. 2 is a block diagram illustrating a display device according to an embodiment of the disclosure.

Referring to FIG. 2, the display device 100 according to an embodiment may include a display panel 110, a sensor 120, a driver IC 130, a memory 140, and a processor 150.

The display panel 110 may display various images. The display panel 110 may display a test image for generating correction data.

The test image may be a white color image, but is not limited thereto, and may be an image of various colors, such as a red color image or a green color image. The test image may be a pattern image including a plurality of regions having different grayscale values. For display of the test image, the memory 140 may pre-store information on the test image. Alternatively, according to an embodiment, the information on the test image may be received from an external device.

The correction data may include information about a correction coefficient (e.g., a gain ratio or a duty ratio) to be applied to a current value being input to a plurality of pixels of the display panel 110 (or, a voltage value being applied to a plurality of pixels) in order to improve luminance uniformity of the display panel 110. Alternatively, the correction data may include information about correction coefficients to be applied to grayscale values of a plurality of pixels.

The correction data may include information on a position of a pixel to be corrected among a plurality of pixels of the display panel 110.

Each pixel of the display panel 110 may include a plurality of light emitting elements. Here, the light emitting element is a self-emissive LED, and may include, for example, an R sub-pixel, a G sub-pixel, and a B sub-pixel. In this example, each pixel may emit light based on an input current (or applied voltage) by the driver IC 130, and may output light of various brightness based on the magnitude of the input current by the driver IC 130 (or the magnitude of the applied voltage).

This is merely exemplary, and the display panel 110 may be implemented as a display of various types such as a liquid crystal display (LCD), organic light emitting diodes (OLED), liquid crystal on silicon (LCoS), digital light processing (DLP), or the like. In the display panel 110, a backlight unit, a driving circuit which may be implemented as an a-si TFT, low temperature poly silicon (LTPS) TFT, organic TFT (OTFT), or the like, may be included as well.

The sensor 120 may sense the temperature of the display panel 110. The sensor 120 may be disposed on the rear surface of the substrate inside the display panel 110, detect the temperature of the display panel 110, and transmit information on the sensed temperature to the processor 150.

For example, as described with reference to FIG. 1B, the sensor 120 may be disposed on the second surface of the substrate 10 included in the display panel 110 and may sense the temperature of the display panel 110. The sensor 120 may be disposed adjacent to a region in which the driver IC 130 is disposed among the second surface of the substrate 10. Accordingly, the sensor 120 may more sensitively detect the temperature of the display panel 110 that is changed by the heat generated by the driver IC 130. Since the sensor 120 is disposed inside the display panel 110, the sensor 120 may accurately sense the temperature of the display panel 100 without being affected by changes in the temperature (e.g., indoor temperature in a house) around the display device 100.

The position of the sensor 120 described above is merely an example, and the sensor 120 may be disposed at various positions capable of sensing temperature of the display panel 110.

The driver IC 130 may control light emission of a plurality of pixels based on a signal received from the processor 150. The driver IC 130 may control the light emission of each pixel and the intensity of light emitted by each pixel by receiving a signal for controlling light emission of a plurality of pixels of the display panel 110 from the processor 150, and inputting a driving current to the plurality of pixels according to the light emission control signal (or, by applying a driving voltage). The driver IC 130 may be electrically connected to the processor 150 and electrically connected to the R sub-pixel, the G sub-pixel, and the B sub-pixel included in each pixel.

The memory 140 may store an operating system (OS) for controlling the overall operation of the components of the display device 100 and instructions or data associated with the components of the display device 100.

The processor 150 may control multiple hardware or software components of the display device 100 using various instructions or data stored in the memory 140. The processor 150 may also load instructions or data received from at least one of the other components into the volatile memory and store the various data in the non-volatile memory.

The memory 140 may store correction data for improving the luminance uniformity of the display panel 110. The memory 140 may store a plurality of correction data generated in a state where different temperatures are sensed by the sensor 120. For example, the memory 140 may store first correction data generated in a state in which a first temperature (e.g., 40 degrees) is sensed by the sensor 120 and second correction data generated in a state in which a second temperature (e.g., 50 degrees) is sensed by the sensor 120.

The processor 150 controls the overall operation of the display device 100. The processor 150 may include at least one of a central processing unit (CPU), an application processor (AP), or a communication processor (CP). Alternatively, the processor 150 may include a timing controller.

The processor 150 may control hardware or software components connected to the processor 150 by driving an operating system or an application program, and may perform various data processing and operations. The processor 150 may load and process instructions or data received from at least one of the other components into the volatile memory, and store various data in the non-volatile memory.

The processor 150 may correct image data based on correction data stored in the memory 140.

As described above, the plurality of pixels included in the display panel 110 may emit light according to the driving of the driver IC 130. The driver IC 130 may control the light emission of each pixel by inputting a current (or applying a voltage) to each of the plurality of pixels, and adjust the magnitude of the input current to each pixel (or the magnitude of voltage applied to each pixel) to control the intensity of light emitted by each pixel.

Figure 3A:
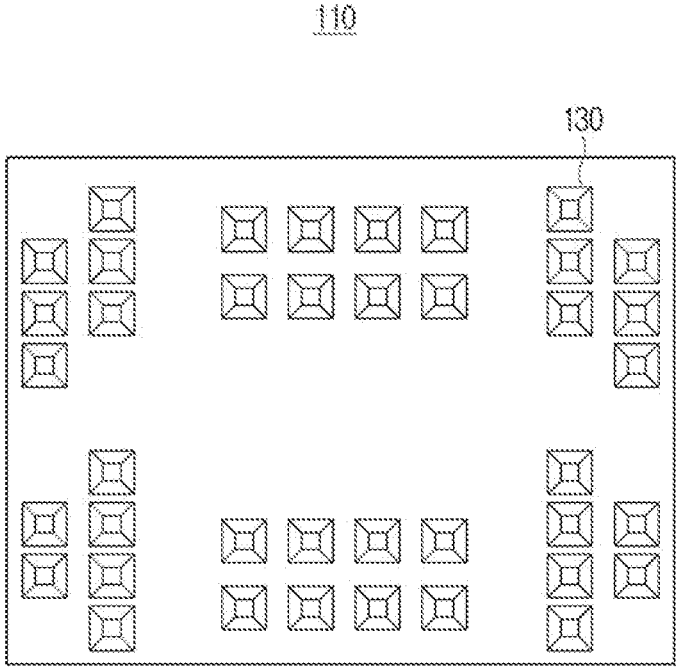
FIG. 3A is a diagram illustrating a substrate according to an embodiment of the disclosure.
Figure 3B:
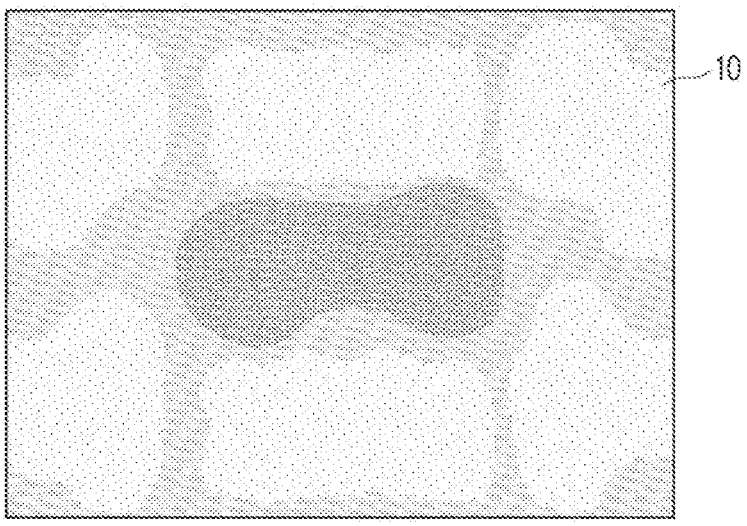
FIG. 3B is a diagram illustrating a temperature sensed by a substrate according to an embodiment of the disclosure.

When the driver IC 130 is driven, the driver IC 130 may generate heat, and accordingly, high temperature may be applied to pixels adjacent to the driver IC 130. For example, when the plurality of driver ICs 130 are positioned on the second surface of the substrate 10 as shown in FIG. 3A, in the region in which the driver IC 130 is positioned among the plurality of regions of the second surface is the driver IC 130, heat may be generated according to driving of the driver IC 130. Accordingly, the pixels (or pixels in the peripheral area) located on the first surface of the substrate 10 opposite to the area in which the driver IC 130 is located are subjected to heat generated by the driver IC 130, as heat generated by the driver IC 130 is added. For example, when the display panel 110 displaying an image is photographed with a thermal imaging camera, as shown in FIG. 3B, among a plurality of areas of the display panel 110, relatively high temperature is detected in an area 10 of a pixel (or a pixel of a peripheral area) located on a first surface of the substrate 10 facing an area where the driver IC 130 is located among a plurality of areas of the display panel 110, as compared to other areas.

In general, a pixel such as an LED has a characteristic in which the intensity of light outputted as the temperature increases, and in this case, a pixel to which heat is applied may output light having a low luminance, and accordingly, a problem in which the luminance uniformity of the screen is degraded may occur.

To address this problem, the correction data generation system 1 of the disclosure may generate correction data for improving luminance uniformity. This will be described in detail with reference to FIG. 4.

Figure 4:
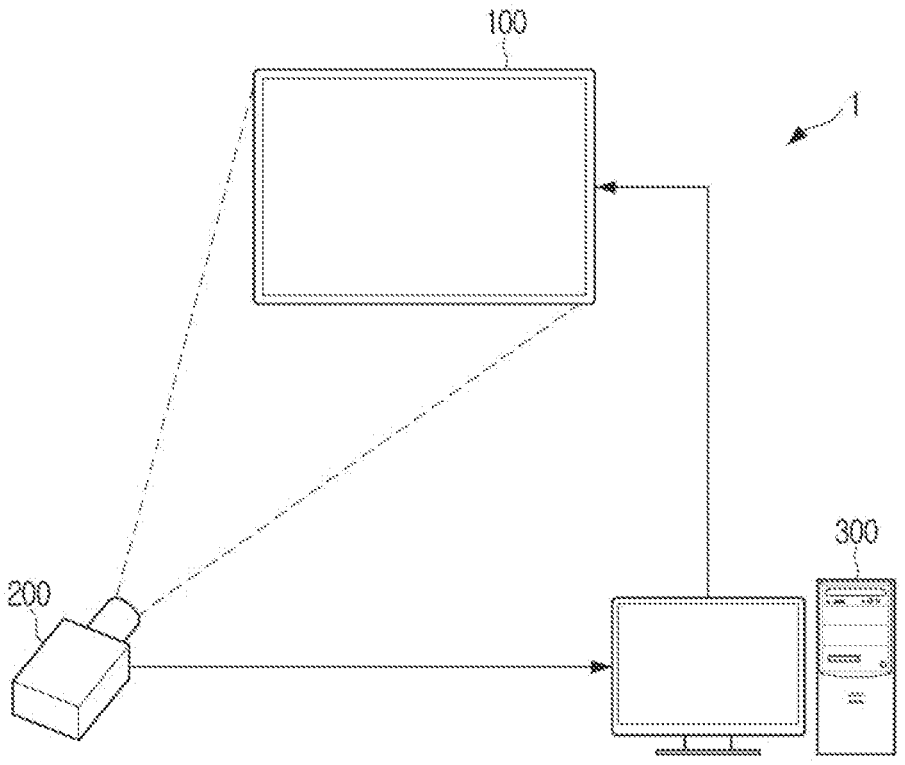
FIG. 4 is a diagram illustrating a method of generating correction data according to an embodiment of the disclosure.

FIG. 4 is a diagram illustrating a method of generating correction data according to an embodiment of the disclosure.

Referring to FIG. 4, the correction data generation system 1 according to an embodiment may include a the display device 100, a first external device 200, and a second external device 300.

The processor 150 may display a test image for correction data generation on the display panel 110. As described above, the test image may be an image of a white color, but is not limited thereto and may be an image of various colors such as an image of a red color, an image of a green color, and the like. In addition, the test image may be a pattern image including a plurality of regions having different gradation values. The information on the test image may be received from the second external device 300, and may be stored in the display device 100.

The processor 150 may determine the temperature sensed by the sensor 120 while displaying the test image. The processor 150 may be electrically connected to the sensor 120 and may receive information about the temperature sensed by the sensor 120 from the sensor 120.

The processor 150 may display the test image multiple times in a state where different temperatures are sensed by the sensor 120. Accordingly, according to the disclosure, a plurality of correction data different for each temperature may be generated. For example, the processor 150 may display the test image while the first temperature is sensed by the sensor 120, and may display the test image when the second temperature is sensed by the sensor 120. A first correction data may be generated based on the displayed test image while the first temperature is sensed, and second correction data may be generated based on the displayed test image while the second temperature is sensed.

The first external device 200 is a device for measuring luminance, and may photograph a test image displayed on the display device 100. The first external device 200 may generate information on a luminance value for each pixel of the display device 100 through color analysis of the photographed test image. Specifically, the first external device 200 may generate information on the luminance values of each of the R sub-pixels, the G sub-pixels, and the B sub-pixels of the display device 100 through analysis of the test image, and may generate information on the luminance values of each pixel including the R sub-pixels, the G sub-pixels, and the B sub-pixels.

The first external device 200 may divide the screen of the display device 100 into a plurality of regions based on the number of pixels and the size of the pixel, and may measure the luminance of each of the plurality of regions. Alternatively, the first external device 200 may divide the screen into a plurality of regions based on the number of sub-pixels and the size of the sub-pixel, and measure the luminance of each of the plurality of regions.

The first external device 200 may be a spectral light meter that measures the luminance of the display device 100 by detecting the intensity of light passing through the optical filter. This is merely exemplary, and the first external device 200 may separate the light into wavelength components and detect the intensity of each wavelength component, so as to be implemented with various luminance systems such as a photoelectric color meter for measuring the luminance of the display device 100.

The second external device 300 may generate correction data based on information on the brightness value for each pixel (or sub-pixel) generated by the first external device 100. The second external device 300 may communicate with the first external device 200 to receive information on a luminance value for each pixel (or sub-pixel) measured by the first external device 200.

The second external device 300 may calculate a target luminance value of light emitted by a plurality of pixels (or sub-pixels) based on information on a grayscale value of a pixel (or a sub-pixel) included in the test image data, and generate correction data based on a difference between a target luminance value for each pixel (or sub-pixel) and a luminance value for each pixel (or sub-pixel) received from the first external device 200.

The correction data may include information about a position of a pixel (or sub-pixel) to be corrected or information about a correction coefficient by pixels (or sub-pixels).

The second external device 300 may determine a pixel (or sub-pixel) that outputs light of a luminance value different from the target luminance value as a target pixel (or sub-pixel) to be corrected, and determine a correction coefficient based on the target luminance value of the corresponding pixel (or sub-pixel) and a ratio of the luminance value of the corresponding pixel (or sub-pixel).

For example, if the target luminance value of the first sub-pixel is 100 and the luminance value of the first sub-pixel is 80, the second external device 300 may determine the first sub-pixel as a correction target and determine the gain ratio of 0.8 as the correction coefficient of the first sub-pixel. This is an embodiment, and if the target luminance value of the first sub-pixel is 100, the luminance value of the second sub-pixel is 80, the target luminance value of the second sub-pixel is 100, and the luminance value of the second sub-pixel is 100, the second external device 300 may set the second sub-pixel as a correction target, and may determine gain ratio of 1.25 as the correction coefficient of the second sub-pixel. The second external device 300 may determine one of the pixels having a luminance value lower than the target luminance value and a pixel having a luminance value higher than the target luminance value as a pixel to be corrected.

The second external device 300 may generate a plurality of correction data based on the luminance data generated by the first external device 200 while the display device 100 displays the test image in different environments.

For example, the second external device 300 may generate the first correction data based on the first luminance data when the first luminance data is generated by the first external device 200 based on a test image displayed in a state in which the first temperature is sensed by the sensor 120 of the display device 100, and may generate second correction data based on the second luminance data when the second luminance data is generated by the first external device 200 based on a test image displayed in a state where the second temperature is sensed by the sensor 120 of the display device 100.

The display device 100 may display a test image in a state in which the first temperature is sensed by the sensor 120, and the first external device 200 may transmit the first luminance data generated through analysis of the test image to the second external device 300, and the second external device 300 may generate the first correction data corresponding to the first temperature based on the first luminance data and the target luminance value corresponding to the test image. The display device 100 may display a test image in a state where the second temperature is sensed by the sensor 120, and the first external device 200 may transmit the second luminance data generated through analysis of the test image to the second external device 300, and the second external device 300 may generate second correction data corresponding to the second temperature based on the second luminance data and a target luminance value corresponding to the test image.

The second external device 300 may transmit correction data to the display device 100. The second external device 300 may be communicatively connected with the display device 100.

The processor 150 may store the correction data received from the second external device 300 in the memory 140. The processor 150 may match the temperature sensed by the sensor 120 to the correction data while the test image is displayed and store the same in the memory 140.

For example, when the first correction data is received from the second external device 300 in a state in which the first temperature is sensed by the sensor 120 as the test image is displayed in the first environment, the processor 150 may match the first temperature with the first correction data and store the data, and as the test image is displayed in the second environment, the processor 150 may match and store the second temperature and the second correction data, when the second correction data is received from the second external device 300 in a state where the second temperature is sensed by the sensor 120 as the test image is displayed in the second environment.

The correction data of the disclosure may be stored in the memory 140 as a look-up table.

For example, a plurality of driver ICs 130 may be disposed on the second surface of the substrate 10 of the display panel 110 as illustrated in FIG. 3A, and a plurality of pixels may be arranged on the first surface by 10 by 10 format.

In this case, in a state in which the first temperature is sensed by the sensor 120, the luminance value 510 for each pixel measured by the first external device 200 may be as shown in FIG. 5A. Among the plurality of pixels, a pixel disposed at a position facing the driver IC 130 (or a peripheral position thereof) may have a relatively low luminance value due to a high temperature, and other pixels may have a relatively high luminance value.

In this example, the first correction data may be stored in the memory 140 in the form of a lookup table as shown in FIG. 5B. Referring to FIG. 5B, the position of the pixel to be corrected and the correction coefficient for each pixel may be determined based on a distance from the driver IC 120. Specifically, the pixel to be corrected is a pixel located at a distance relatively close to the driver IC 120, and the correction coefficient for each pixel is set to be smaller as the distance from the driver IC 120 is farther. According to an embodiment, the pixel to be corrected may be a pixel located at a distance relatively far from the driver IC 120, and the correction coefficient for each pixel may be set to be larger as the distance from the driver IC 120 is farther.

As described above, the processor 150 may obtain the second correction data generated in a state where second temperature different from the first temperature is sensed by the sensor 120.

As an example, with a second temperature sensed by the sensor 120, the luminance value 610 by pixels measured by the first external device 200 may be as illustrated in FIG. 6A.

The second correction data may be stored in the memory 140 in the form of a lookup table as shown in FIG. 6B. Referring to FIGS. 5B and 6B, the position of the pixel to be corrected and the correction coefficient for each pixel are different depending on the temperature sensed by the sensor 120 as well as the distance from the driver IC 120. When the second temperature is higher than the first temperature, the correction coefficient of the second correction data generated at the second temperature is smaller than the correction coefficient of the first correction data generated at the first temperature, and a number of the correction target according to the second correction data is more than a number of the correction target according to the first correction data.

Since the correction coefficient has a value greater than 0 and less than or equal to 1, a luminance value of a pixel driven based on the corrected image data may be lower than a luminance value based on the image data before correction.

As illustrated in FIGS. 5B and 6B, the position of a pixel to be corrected and/or a correction coefficient for each pixel included in each of the plurality of correction data may be different for each of the plurality of correction data. This is because each of the plurality of correction data is generated at a different temperature, and the pixel emits light with a different luminance value according to the temperature.

However, such correction data is an embodiment, wherein the pixels or correction coefficients to be compensated according to the embodiment may be some the same, even if the temperature is different.

The correction data for a plurality of pixels is shown in FIGS. 5A-6B, it will be considered that the technical spirit of the disclosure can also be applied in the case of generating correction data for a plurality of subpixels.

When image data is received from the outside, the processor 150 may display an image based on the corrected image data based on the correction data. When image data is received from the outside, the processor 150 may determine the temperature sensed by the sensor 120. The processor 150 may identify correction data corresponding to the temperature sensed by the sensor 120 among the plurality of correction data stored in the memory 140. The processor 150 may identify information about the temperature matched to each of the plurality of correction data.

For example, if the temperature sensed by the sensor 120 is the first temperature, the processor 150 may identify the correction data matched with the first temperature among the plurality of correction data stored in the memory 140, and if the temperature sensed by the sensor 120 is the second temperature, the processor 150 may identify the correction data matched with the second temperature among the plurality of correction data stored in the memory 140.

The processor 150 may correct the image data according to the correction data. The processor 150 may determine the position of the pixel to be corrected and the correction coefficient of the pixel to be corrected based on the correction data, and correct the gray scale value of the pixel to be corrected according to the correction coefficient. For example, if the gray scale value of the particular pixel determined by the image data is a (e.g., 100) and the correction coefficient of the corresponding pixel is b (e.g., 0.8), the processor 150 may correct the gray value of the corresponding pixel to a*b (e.g., 80), and control the driver IC 120 to emit light having a gray scale value of a*b.

It has been described that the gray scale value is corrected according to the correction coefficient, the processor 140 may correct the magnitude of the current output to each pixel (or sub-pixel) or the magnitude of the voltage applied to each pixel (or sub-pixel) according to the correction coefficient.

The driver IC 120 may receive corrected image data from the processor 150 and control a plurality of pixels (or sub-pixels) according to the corrected image data. Accordingly, an image having a high luminance uniformity may be displayed on the display panel 110.

As such, the display device 100 of the disclosure may provide an image having high luminance uniformity in even various environments by correcting image data according to correction data determined based on the temperature of the display panel 110.

The correction data including information about a correction coefficient by pixels has been described but according to an embodiment, correction data including information about a correction coefficient by sub-pixels may be stored in the memory 140 according to an embodiment.

In this example, the processor 150 may correct the image data based on the correction data including information on the correction coefficient for each sub-pixel. The processor 150 may correct image data corresponding to the R sub-pixel among the plurality of light emitting devices based on the correction data. This considers that the R sub-pixel is relatively more sensitive to temperature than the G sub-pixel and the B sub-pixel, and thus the R sub-pixel has a greater effect on the decrease in luminance as the temperature increases than the G sub-pixel and the B sub-pixel.

The processor 150 may determine an R sub-pixel to be corrected based on the correction data, and correct the gray scale value of the R sub-pixel based on the correction data. The processor 150 may transmit image data corrected according to the correction data to the driver IC 120, and the driver IC may control light emission of a plurality of sub-pixels based on the corrected image data.

Accordingly, the disclosure may provide an image having high luminance uniformity with only data correction of the R sub-pixel.

FIG. 7 is a diagram illustrating an embodiment of generating correction data based on interpolation according to an embodiment of the disclosure.

The processor 150 may generate new correction data based on a plurality of correction data stored in the memory 140.

In detail, the processor 150 may generate new correction data by applying interpolation to a plurality of correction data stored in the memory 140.

For example, when the temperature sensed by the sensor 120 is the third temperature, but the correction data matched with the third temperature is not stored in the memory 140, the processor 150 may generate third correction data corresponding to the third temperature by applying interpolation to the first correction data corresponding to the first temperature lower than the third temperature and the second correction data corresponding to the second temperature higher than the third temperature.

Specifically, referring to FIG. 7, the processor 150 may obtain the first correction data 520 corresponding to the first temperature and the second correction data 620 corresponding to the second temperature from the memory 140, and may generate the third correction data 720 corresponding to the third temperature by applying interpolation to the correction coefficient for each pixel of the first and second correction data 520 and 620.

The processor 150 may correct the image data based on the third correction data and control the driver IC 130 to display the image according to the corrected image data.

By generating new correction data through interpolation, the disclosure may correct image data according to correction data most suitable to various environments.

Figure 8:
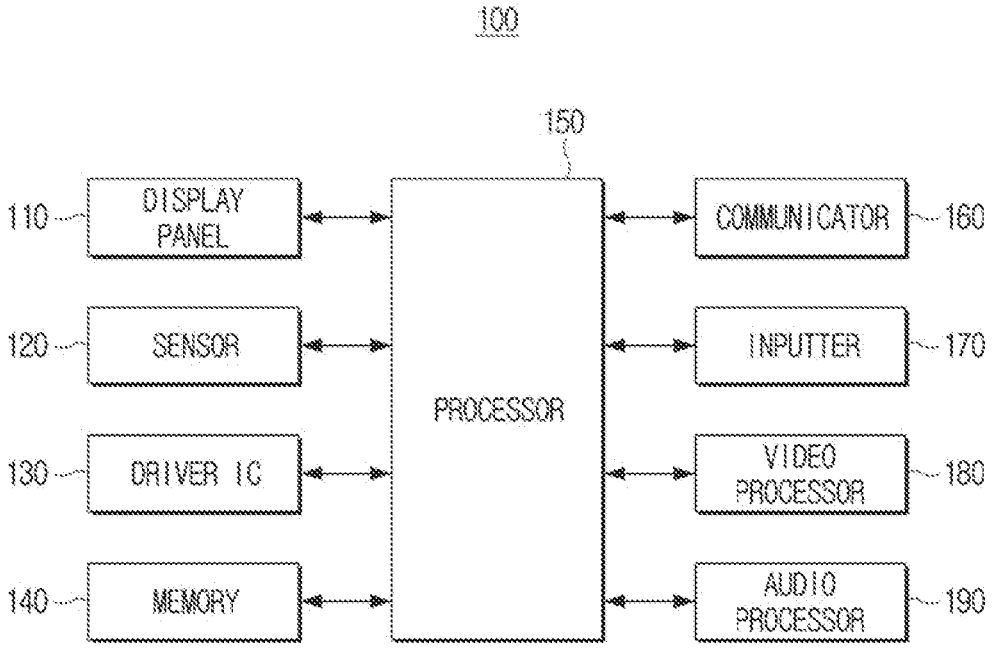
FIG. 8 is a detailed block diagram illustrating a display device according to an embodiment of the disclosure.

FIG. 8 is a detailed block diagram illustrating a display device according to an embodiment of the disclosure.

Referring to FIG. 8, the display device 100 according to an embodiment of the disclosure includes the display panel 110, the sensor 120, the driver IC 130, the memory 140, the communicator 160, an inputter 170, a video processor 180, an audio processor 190, and a processor 150. Hereinafter, parts overlapping with the above description will be omitted or abbreviated.

The communicator 160 may communicate with various electronic devices according to various types of communication methods. For example, the communicator 160 may communicate with the second external device 300 to receive correction data. Here, the correction data may be different according to the temperature of the display panel.

The communicator 160 may include a communication module such as a near-field wireless communication module or a wireless LAN communication module. The near-field wireless communication module is a communication module that wirelessly performs data communication with an electronic device located in a short distance, for example, a Bluetooth module, a ZigBee module, and a Near Field Communication (NFC) module. The wireless LAN communication module may be a module that is connected to an external network and performs communication according to a wireless communication protocol such as WiFi or IEEE.

In addition, the communicator 160 may include a mobile communication module that accesses and communicates with a mobile communication network according to various mobile communication standards such as third Generation (3G), third Generation Partnership Project (3GPP), Long Term Evolution (LTE), fifth Generation (5G), and the like. In addition, the communicator 160 may include at least one of a wired communication module such as Universal Serial Bus (USB), Institute of Electrical and Elementary Engineers (IEEE) 1394, RS-232, and the like, or may include a broadcast receiving module for receiving TV broadcast.

The inputter 170 may receive various user commands for controlling the operation of the display device 100. For example, the inputter 170 may receive a user command for receiving or displaying a test image or a user command for generating correction data.

The inputter 170 may be implemented as various input devices capable of controlling the display device 100 such as various buttons or touch sensors.

The video processor 180 may process an image signal including an image frame received through the communicator 160. The video processor 180 may perform decoding, scaling, noise filtering, frame rate conversion, resolution conversion, and the like of an image signal. The image frame processed by the video processor 180 may be displayed on the display panel 110.

The audio processor 190 may process an audio signal received through the communicator 170. The audio processor 190 may perform decoding, amplification, and noise filtering of the audio signal. The audio signal processed by the audio processor 190 may be output through an audio outputter.

The audio outputter may output various audio signals, notification sounds, or voice messages processed by the audio processor 190.

Figure 9:
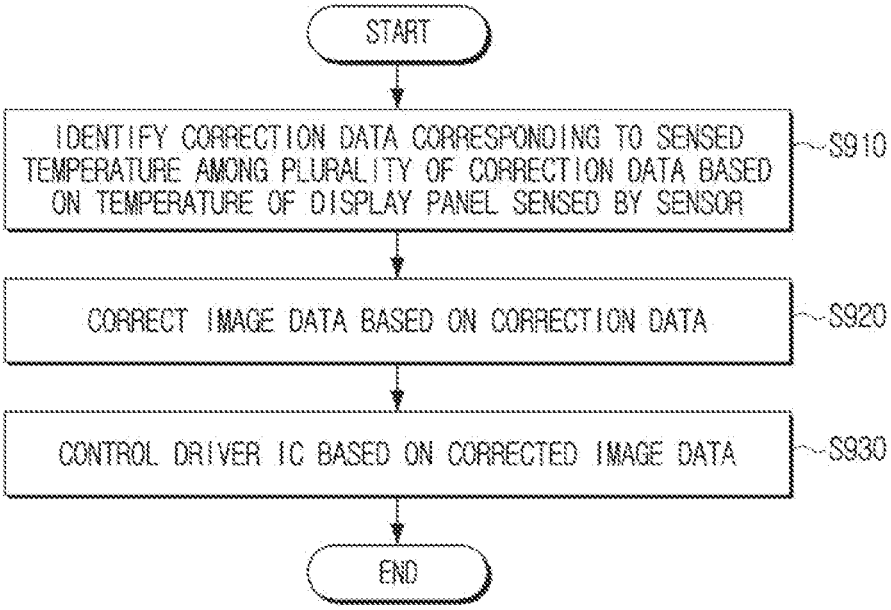
FIG. 9 is a flow chart illustrating a method of controlling a display device according to an embodiment of the disclosure.

FIG. 9 is a flow chart illustrating a method of controlling a display device according to an embodiment of the disclosure.

The display device 100 may identify correction data corresponding to the sensed temperature among the plurality of correction data based on the temperature of the display panel sensed by the sensor in operation S910. The plurality of correction data are data stored in the display device 100, and each correction data may be generated in a state in which different temperatures are sensed by the sensor. For example, the first correction data may be generated while the first temperature is sensed by the sensor, and the second correction data may be data generated while the second temperature is sensed by the sensor.

The display device 100 may correct the image data based on the correction data in operation S920. The image data may be data stored in the display device 100 as well as data received from an external device.

The display device 100 may determine the position of the pixel to be corrected included in the correction data and the correction coefficient of the corresponding pixel, and correct the grayscale value of the pixel to be corrected according to the correction coefficient.

In operation S930, the display device 100 may control the driver IC to control the plurality of pixels based on the corrected image data according to the correction data. The driver IC may control light emission of a plurality of pixels according to the corrected image data, and the display device 100 may display an image having high luminance uniformity.

Methods according to the embodiments as described above may be implemented as an application or software executable in an existing display device.

Methods according to the embodiments as described above may be implemented as software or hardware upgrade of an existing display device.

Embodiments described above may be performed through an embedded server provided in a display device, or an external server of a display device.

A non-transitory computer readable medium in which a program sequentially performing a control method of a display device according to the disclosure may be provided.

The non-transitory computer-readable medium does not refer to a medium that stores data for a short period of time, such as a register, cache, memory, etc., but semi-permanently stores data and is available of reading by the device. Specifically, programs of performing the above-described various methods can be stored in a non-transitory computer readable medium such as a CD, a DVD, a hard disk, a Blu-ray disk, universal serial bus (USB), a memory card, ROM, or the like, and can be provided.

In addition, while example embodiments of the disclosure have been illustrated and described, the disclosure is not limited to the specific embodiments described above. It will be understood by those skilled in the art that various changes in form and details may be made therein without departing from the true spirit and full scope of the disclosure, including the appended claims and their equivalents.

What is claimed is:

1. A display device comprising:

a display panel comprising a plurality of pixels of a plurality of light emitting elements of different colors;

a sensor configured to sense a temperature of the display panel;

a driver integrated circuit (IC) configured to drive the plurality of pixels;

a memory storing a plurality of correction data corresponding to a plurality of temperatures, and at least one instruction; and a processor configured to execute the at least one instruction to:

identify, based on the temperature of the display panel, correction data corresponding to the temperature of the display panel from among the plurality of correction data, correct image data based on information about positions of pixels to be corrected and information about correction coefficients for each pixel included in each of the plurality of correction data, and control the driver IC based on the corrected image data, wherein at least one of the information about positions of pixels to be corrected and the information about correction coefficients for each pixel may be different for each of the plurality of correction data.

2. The display device of claim 1, wherein the driver IC is disposed on a rear surface of a substrate inside the display panel, and wherein the positions of pixels to be corrected and the correction coefficients for each pixel, included in each of the plurality of correction data, are determined based on distance from the driver IC.

3. The display device of claim 2, wherein the correction coefficients for each pixel are set to be smaller as the distance from the driver IC is farther.

4. The display device of claim 2, wherein a plurality of driver ICs are disposed on the rear surface of the display panel, and wherein the sensor is disposed at a region adjacent to the plurality of driver ICs.

5. The display device of claim 1, wherein a luminance value of at least one of the plurality of pixels is lower than a luminance value based on the image data before the image data is corrected.

6. The display device of claim 1, wherein the plurality of correction data is obtained, in a state where each of the plurality of temperatures is sensed by the sensor, based on luminance values of the plurality of pixels measured while a test image is displayed on the display panel.

7. The display device of claim 1, wherein each of the plurality of pixels comprise a plurality of light emitting elements, and the plurality of light-emitting elements comprise a red (R) sub-pixel, a green (G) sub-pixel, and a blue (B) sub-pixel, and wherein the processor is further configured to correct, based on the correction data, the image data corresponding to the R sub-pixel among the plurality of light emitting elements included in at least one of the plurality of pixels.

8. The display device of claim 7, wherein the plurality of light emitting elements is a micro light emitting diode (LED).

9. The display device of claim 1, wherein the processor is further configured to execute the instructions to:

generate, based on the temperature sensed by the sensor being a third temperature between a first temperature and a second temperature, first correction data corresponding to the first temperature and third correction data corresponding to the third temperature by applying interpolation to second correction data corresponding to the second temperature, among the plurality of correction data; and correct the image data based on the third correction data.

10. The display device of claim 1, wherein the sensor is disposed on a substrate inside the display panel.

11. A method of controlling a display device comprising a plurality of pixels of a plurality of light emitting elements of different colors, comprising:

identifying correction data corresponding to a sensed temperature from among a plurality of correction data;

correcting an image data based on information about positions of pixels to be corrected and information about correction coefficients for each pixel included in the correction data; and controlling a driver integrated circuit (IC) based on the corrected image data, wherein at least one of the information about positions of pixels to be corrected and the information about correction coefficients for each pixel may be different for each of the plurality of correction data.

12. The method of claim 11, wherein the driver IC is disposed on a rear surface of a substrate inside the display device, and wherein the positions of pixels to be corrected and the correction coefficients for each pixel, included in each of the plurality of correction data, are determined based on distance from the driver IC.

13. The method of claim 12, wherein the correction coefficients for each pixel are set to be smaller as the distance from the driver IC is farther.

14. The method of claim 11, wherein a luminance value of at least one of the plurality of pixels is lower than a luminance value based on the image data before the image data is corrected.

15. The method of claim 11, wherein the plurality of correction data is obtained, in a state where each of a plurality of temperatures is sensed by a sensor, based on luminance values of the plurality of pixels measured while a test image is displayed on a display panel of the display device.

16. A non-transitory computer readable medium for storing computer readable program code or instructions which are executable by one or more processors to perform a method of controlling a display device comprising a plurality of pixels of a plurality of light emitting elements of different colors, the method comprising:

identifying correction data corresponding to a sensed temperature from among a plurality of correction data;

correcting an image data based on information about positions of pixels to be corrected and information about correction coefficients for each pixel included in the correction data; and controlling a driver integrated circuit (IC) based on the corrected image data, wherein at least one of the information about positions of pixels to be corrected and the information about correction coefficients for each pixel may be different for each of the plurality of correction data.

17. The non-transitory computer readable medium of claim 16, wherein the driver IC is disposed on a rear surface of a substrate inside the display device, and wherein the positions of pixels to be corrected and the correction coefficients for each pixel, included in each of the plurality of correction data, are determined based on distance from the driver IC.

18. The non-transitory computer readable medium of claim 17, wherein the correction coefficients for each pixel are set to be smaller as the distance from the driver IC is farther.

19. The non-transitory computer readable medium of claim 16, wherein a luminance value of at least one of the plurality of pixels is lower than a luminance value based on the image data before the image data is corrected.

20. The non-transitory computer readable medium of claim 16, wherein the plurality of correction data is obtained, in a state where each of a plurality of temperatures is sensed by a sensor, based on luminance values of the plurality of pixels measured while a test image is displayed on a display panel of the display device.

* * * * *